US005957202A

United States Patent [19]

Huang

[11] Patent Number: 5,957,202

[45] Date of Patent: Sep. 28, 1999

[54] COMBINATION PRODUCTION OF SHALLOW HEAVY CRUDE

[75] Inventor: Wann-Sheng Huang, Houston, Tex.

[73] Assignee: Texaco Inc., White Plains, N.Y.

[21] Appl. No.: 08/815,653

[22] Filed: Mar. 13, 1997

[51] Int. Cl.[6] ..... E21B 43/24

[52] U.S. Cl. ..... 166/272.3; 166/272.7

[58] Field of Search ..... 166/263, 272.3, 166/272.7, 303

[56] References Cited

U.S. PATENT DOCUMENTS

| | | | |
|---|---|---|---|
| 4,718,485 | 1/1988 | Brown et al. | 166/263 X |
| 4,727,937 | 3/1988 | Shum et al. | 166/272.7 |
| 5,246,071 | 9/1993 | Chu | 166/263 |
| 5,305,829 | 4/1994 | Kumar | 166/272.3 |
| 5,318,124 | 6/1994 | Ong et al. | 166/263 |
| 5,320,170 | 6/1994 | Huang et al. | 166/263 |

*Primary Examiner*—William Neuder
*Attorney, Agent, or Firm*—Henry H. Gibson; William J. Beard

[57] ABSTRACT

Techniques are disclosed for the safe production of shallow heavy oil sands which substantially reduce the probability of surface steam breakthrough. A pattern of injection wells and producing wells are drilled through the overburden into a relatively shallow heavy oil producing zone. Firstly the injection wells and the producing wells are cold produced for a combination of heavy oil and sand by use of a progressive cavity pump or the like. Then steam push-pull is used on both the injectors and producers until heavy oil production becomes uneconomical. Finally, low pressure steam is continuously injected into the injection well and heavy oil continuously produced from the producing wells.

14 Claims, 2 Drawing Sheets

COMBINATION PRODUCTION OF SHALLOW HEAVY CRUDE

FIELD OF THE INVENTION

This invention relates to oil and gas reservoir production techniques and, more particularly, to techniques for the production of heavy oil in shallow reservoirs which avoid potentially damaging environmental effects caused by surface steamflood breakthroughs.

BACKGROUND OF THE INVENTION

In some areas of the world there are really large deposits of very viscous or heavy crude oils or tar sands which are located near the surface of the earth. The overburden in such areas may be as little a two to three hundred feet. In such cases the overburden is thick enough to effectively prevent the surface strip mining of the heavy oil deposit, but it may be, like the heavy oil sand itself, loosely consolidated and not, in effect, a good sealant of the heavy oil sand from the surface.

One especially effective technique used in the past for producing such heavy tar or oil sand formations has been steam flooding of the formation. In steam flooding a pattern of wells is drilled vertically through the overburden and into the heavy oil sand, usually penetrating the entire depth of the sand. Casing is put in place and perforated in the producing interval and then steam generated at the surface is pumped under relatively high pressure down the casing and into the heavy oil formation. In some instances the steam may be pumped for awhile into all of the wells drilled into the producing formation and, after the heat has been used to lower the viscosity of the heavy oil near the wellbore then the steam is removed and the heated, lowered viscosity, oil is pumped to surface, having entered the casing through the perforations. When the heat has dissipated and the heavy oil production falls off, the production is closed and the steam flood resumed. Where the same wells are used to inject steam for awhile and then for production, this technique has been known as the huff and puff method or the push-pull method.

In other instances, some of the vertical wells penetrating the heavy oil sand are used to continuously inject steam while others are used to continuously produce lower viscosity oil heated by the steam. Again, when heavy oil production falls off due to lack of heat, the role of the injectors and producers can be reversed to allow injected steam to reach new portions of the reservoir and the process repeated.

In all of these production techniques, the steam flood is performed at a relatively high pressure (hundreds to over one thousand pounds per square inch or PSI) so as to allow it to penetrate as deeply into the production zone as possible. This can lead to severe environmental problems if the overburden is relatively incompetent which could be penetrated by the heated crude oil, water or steam pumped into the injection wells. Steam breakout to the surface has occurred on more than one occasion in the past when using such production techniques. This can result in serious environmental contamination, particularly if the steam breakout occurs as geysers of hot water and lowered viscosity crude oil onto the earth's surface, as has occurred in the past.

Accordingly, it would be very desirable to develop techniques for effectively producing heavy oils in shallow reservoirs in which steam flooding could be used, but with lower injection pressures so as to avoid surface breakout. The present invention provides production techniques for use in relatively thin or relatively thick heavy oil sand production zones located at shallow depths. The techniques of the present invention are both safe and efficient in recovering the heavy oil from shallow formations and in lowering the required steamflood pressures so as to minimize the potential of surface steam breakthrough.

BRIEF DESCRIPTION OF THE INVENTION

The techniques of the present invention for safely producing shallow deposits of heavy crude oil basically comprises four steps. The steps may differ slightly depending upon the thickness of the heavy crude production zone, but essentially are as follows: (For a five spot pattern)

1. Drill a vertical injection well and four horizontal producing wells in a five spot pattern.
2. Cold produce heavy crude from both the injector and the producers by producing sand and oil simultaneously using a jet pump, screw pump or a progressive cavity pump.
3. Inject steam into the injection well and the four producing wells at relatively low pressure (less than 100 PSI rather than hundreds of PSI) for a predetermined time. Then produce heavy crude and sand from the injection well and the four producers again. Low pressure injection is achievable because "wormholes" have been created as a result of the initial sand and oil production. The reservoir permeability then becomes much higher. When production falls off due to heat loss reverse the process and again inject low pressure steam into the four horizontal production wells and the injection well for a predetermined period. This cycle is repeated in the huff and puff or push-pull manner until the oil production rate becomes uneconomical.
4. Inject low pressure steam continuously into the vertical injection well and produce oil and sand from the producing wells.

The invention may best be understood by the following detailed description thereof when taken in conjunction with the accompanying drawings. The drawings are intended as illustrative and not as limitative of the invention.

BRIEF DESCRIPTION OF THE INVENTION

FIG. 1A schematically shows a five spot pattern for use with relatively thin shallow heavy oil sands according to the invention; and FIG. 1B schematically shows a five spot pattern for use with relatively thicker shallow heavy oil sands according to the invention.

FIG. 2A schematically shows a seven spot pattern for use with relatively thin heavy oil sands.

FIG. 2B schematically shows a seven spot pattern for use with relatively thicker heavy oil sands.

DETAILED DESCRIPTION OF THE INVENTION

The following descriptions of the technique of the present invention will be described with reference to a particular well placement pattern known as the "five spot" for its resemblance to the five on a pair of dice. However, it will be appreciated by those of skill in the art, that the techniques of the present invention are equally applicable to the safe recovery of shallow heavy crude oil deposits using other placement patterns of injection and/or producing wells, if desired.

Traditionally, the most effective method in recovering heavy oil is by the use of steam floods. Other methods can either recover only small portions of the oil in place or, in some instances, not recover any oil at all. In the case of a shallow heavy oil deposit, the use of high pressure steam injection runs the risk of possible surface breakout of steam and/or steam/water/oil emulsions because of the high injection pressures (several hundreds to over a thousand PSI). In the techniques of the present invention this is avoided because, while using the steam flood techniques basically, only low injection pressures are necessary for the steam injection for reasons which will become apparent as the techniques are described with more particularity.

Figure 1A:
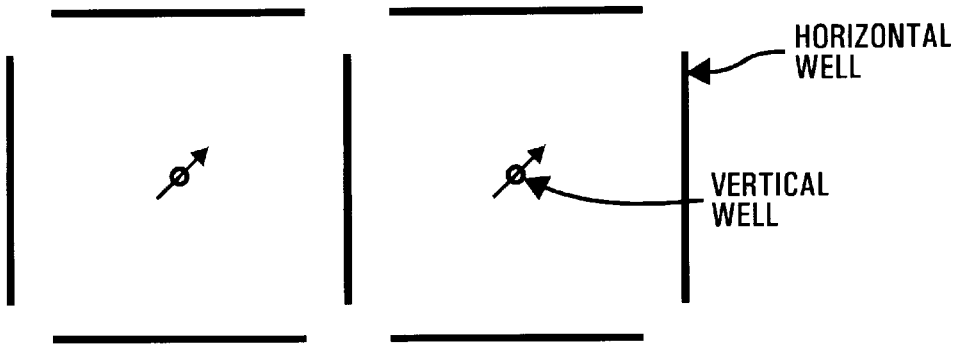
Figure 1B:
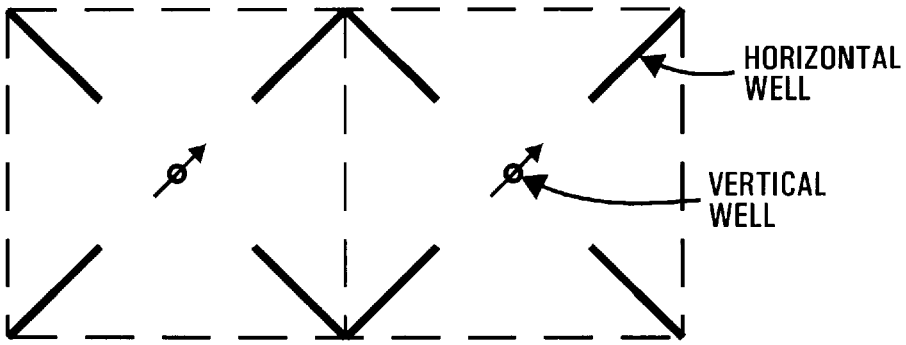

Referring to FIGS. 1A and 1B, schematic views (from above the earths surface) are shown of the recovery techniques of the present invention. FIG. 1A shows a five spot pattern having the central well as an injector well and being oriented vertically. The four corner wells are drilled horizontally (i.e. parallel to the earth's surface) near the bottom of the producing zone and with their well bores oriented along the sides of the "five spot" square as shown.

FIG. 1B shows a five spot pattern in which the center well is drilled vertically and is an injection well, again perforated across the entire production zone. The corner wells of the pattern are again drilled horizontally, but in this instance with their well bores oriented diagonally in the pattern toward the center well. Again the horizontal wells are kept as near the bottom plane of the producing zone as possible and all are perforated all along their horizontal extent. The well placement pattern of FIG. 1A is particularly useful in accordance with concepts of the present invention in production sand intervals which are relatively thin, i.e. 30 feet thickness of less. The pattern of FIG. 1B is particularly useful in relatively thicker production sand intervals of greater than 30 feet in thickness.

Figure 2A:
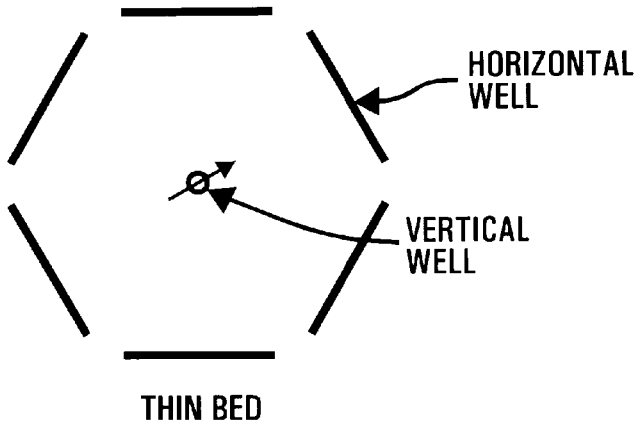

FIG. 2A shows a "seven spot" pattern having the central well drilled as an injector well and being oriented vertically. There are six corner wells which are drilled horizontally near the bottom of the producing zone. The wellbores of the corner well are oriented along the sides of the seven spot hexagon as shown.

Figure 2B:
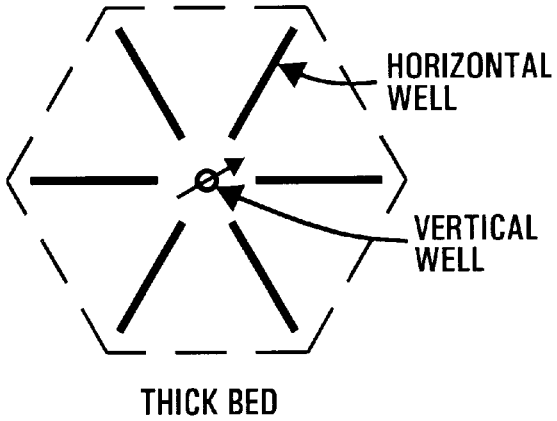

FIG. 2B shows a seven spot pattern in which the center well is drilled vertically and is an injection well. This well is, again, perforated across the entire production zone. The corner wells of this pattern (at the hexagon corners) are again drilled horizontally, but in this instance their well bores are oriented radially toward the center well in the pattern. These wells again are kept as near the bottom plane of the producing zone and all are perforated along their entire horizontal extent. The well placement pattern of FIG. 2A is most useful in relatively thin producing intervals while the pattern of FIG. 2B is more useful in thicker production sands.

The techniques of the present invention may differ slightly according to the thickness of the producing zone as outlined above. However, these techniques may be broken down into four major steps. These steps are:

(1) Drill vertical injection wells and horizontal production wells into the production zone as described above with respect to FIGS. 1A and 1B.

(2) Produce both oil and sand from both the production wells and injection wells cold without the use of steam. Cold production can be achieved by producing oil and sand simultaneously using either a progressive cavity pump, a screw pump or a jet pump. Typically in 12° API heavy oil, very high sand content (40% to 50% by volume) is produced during the first few weeks of production. Sand production then typically declines slowly to about 10% over a period of about 100 days. Continued small percentages of sand production are associated with the oil production. It has been found that from 3% to 8% of the total oil in place can be produced from this commingled oil and sand production.

(3) When production from step (2) becomes not economical, start low pressure (about 250 PSI) steam injection in both the injection wells and the producing wells in the pattern. Use the push-pull or huff and puff technique wherein the steam is injected for a predetermined period of time and then stopped and oil production is begun on both injectors and producers until the production rate is un-economical and then the steam injection cycle is repeated, etc. Because of the initial cold production of oil and sand in step (2) the cavity around the well bores becomes much larger than the casing diameter. Very likely there are channels left behind in the formation by the migrating sand. As a result steam can be injected without a large pressure drop during the steam injection period. After a soaking period, more oil and sand are produced by use of the screw pump, progressive cavity pump, etc. and even more channels and a larger effective well bore are created. This steam push-pull cycle is repeated until the oil production rate becomes uneconomical.

(4) Inject steam into the injection well only and produce oil and sand from the producing wells. By this point, the well bores have become so large that no significant pressure differential is required to inject the steam. Because of the use of only low pressure steam the possibility of steam breakout at the surface is reduced or eliminated. The horizontal producing wells, because of their large drawdown capability, further reduce formation pressure. The strong pressure sink created and enforced by sand channels left behind by the migrating sand, drastically reduce reservoir pressure efficiently through the reservoir. The horizontal wells can provide a line pressure sink in the formation so that the areal efficiency of the continuing steam flood is increased.

The techniques described above may make other alternative arrangements apparent to those of skill in the art. For example, the injection wells could be drilled horizontally also, as long as the operational sequence proceeds as described through the oil and sand cold production stage to produce the enlarged well borehole generated by this process. Also, as previously described, other than five spot or seven spot well placement patterns could be used if desired. Accordingly the aim of the appended claims is to cover all such changes and modifications that fall within the true spirit and scope of the invention.

I claim:

1. A method for producing heavy crude oil from shallow formations while reducing the probability of surface steam breakthrough, comprising the steps of:

drilling and completing a predetermined pattern of injection wells and producing wells through the overburden over a shallow heavy oil producing zone and into the producing zone;

cold producing a combination of heavy oil and sand from the producing zone by use of a heavy oil pumping means for a predetermined period of time, thereby enlarging the borehole effective diameter in the producing zone in the vicinity of the well bores of said injection and producing wells;

injecting low pressure steam into said injection wells and said producing wells simultaneously for a predetermined period of time, to heat and lower the viscosity of the heavy oil near the wellbores of said injection and producing wells, stopping said steam injection and producing a sand and lowered viscosity heated heavy oil from said injection wells and said producing wells simultaneously until the reduced viscosity heavy oil is essentially produced and then repeating this push-pull cycle of low pressure steam injection and heavy oil and sand production until the oil production becomes uneconomical; and injecting low pressure steam into said injection wells and producing heated heavy oil and sand from said producing wells continuously.

2. The method of claim 1 wherein the injection wells are drilled vertically through the producing zone and the producing wells are drilled horizontally near the bottom extent of the producing zone.

3. The method of claim 1 wherein the wells are drilled in a five spot pattern with the injection wells located centrally in the five spot.

4. The method of claim 3 wherein the producing wells are drilled with their horizontal wellbores directed along the periphery of the five spot pattern.

5. The method of claim 3 wherein the producing wells are drilled with their horizontal wellbores located diagonally toward the central well of the five spot pattern.

6. The method of claim 1 wherein the step of injecting low pressure steam is performed by injecting steam at a pressure of less than 250 PSI.

7. The method of claim 6 wherein the step of injecting low pressure stem is preformed by injecting steam at a pressure of less than 100 PSI.

8. The method of claim 1 wherein the producing wells are drilled horizontally near the bottom extent of the producing zone and are perforated along their entire horizontal extent.

9. The method of claim 1 wherein the step of cold producing a combination of heavy oil and sand by use of a heavy oil pumping means is performed by use of a jet pump.

10. The method of claim 1 wherein the step of cold producing a combination of heavy oil and sand by use of a heavy oil pumping means is performed by use of a screw pump.

11. The method of claim 1 wherein the step of cold producing a combination of heavy oil and sand by use of a heavy oil pumping means is performed by use of a progressive cavity pump.

12. The method of claim 1 wherein the wells are drilled in a seven spot pattern with injection wells located centrally in the seven spot pattern.

13. The method of claim 12 wherein the producing wells are drilled with their horizontal wellbores directed along the periphery of the hexagon of the seven spot pattern.

14. The method of claim 12 wherein the producing wells are drilled with their horizontal wellbores oriented radially toward the central well of the seven spot pattern.

* * * * *